United States Patent [19]

Verstraeten

[11] Patent Number: 4,877,357

[45] Date of Patent: Oct. 31, 1989

[54] METHOD AND APPARATUS FOR MAKING A SLURRY TRENCH OR WALL IN THE SOIL

[75] Inventor: Alexander J. Verstraeten, Knokke-Heist, Belgium

[73] Assignee: Funderingstechnieken Verstraeten B.V., Oostburg, Netherlands

[21] Appl. No.: 141,322

[22] Filed: Jan. 6, 1988

[30] Foreign Application Priority Data

Dec. 10, 1987 [NL] Netherlands ..... 8702984

[51] Int. Cl.[4] ..... E02D 5/20

[52] U.S. Cl. ..... 405/267; 405/240

[58] Field of Search ..... 405/267, 232, 233, 240, 405/242, 243

[56] References Cited

U.S. PATENT DOCUMENTS

| | | | |
|---|---|---|---|
| 3,540,225 | 11/1970 | Muller | 405/242 |
| 3,973,408 | 8/1976 | Paverman | 405/267 |
| 4,249,836 | 2/1981 | Schmednecht | 405/267 |
| 4,379,658 | 4/1983 | Schmednecht | 405/267 |

*Primary Examiner*—David H. Corbin
*Attorney, Agent, or Firm*—Kenyon & Kenyon

[57] ABSTRACT

A method and apparatus for making a slurry trench or wall in the soil, comprising driving a beam section into the ground by pile driving, and simultaneously and entirely filling up the trench formed by soil displacement with a supporting fluid. The beam sectional is subsequently pulled out of the soil with a vibrating movement, which is obtained by delivering blows to the beam at a suitable frequency. During this extraction movement, sufficient supporting fluid is supplied for filling up the volume occupied by the beam. The soil displacement portion at the under-side of the beam, in cross section, has a box section with apertured side walls. The box section is shut off at the under-side by a permanent pile shoe or by hinged flaps, so that during extraction of the beam out of the soil, the interior of the box section communicates with the trench formed underneath the flaps or the pile shoe, said trench being thereby filled with supporting fluid.

8 Claims, 2 Drawing Sheets

METHOD AND APPARATUS FOR MAKING A SLURRY TRENCH OR WALL IN THE SOIL

This invention relates to an apparatus for making a slurry trench or wall in the soil, and to a method of making such a trench or wall, using the apparatus.

To isolate for instance rubbish dumps from the environment, it is known to install around the dump a slurry trench or wall in the soil. Several methods and apparatuses are known for making such a trench or wall.

According to a first known method, a trench is excavated in the soil by means of a grab, which trench is kept open during excavation by depositing a tixotropic liquid into the trench, e.g. bentonite. When the trench has been brought at the required depth, the supporting fluid, e.g., bentonite, is replaced by a hardening or stiffening compound consisting e.g. of a mixture of bentonite with cement and a suitable filler. Possibly, the bentonite can also be mixed with soil material excavated from the trench. Such a trench or wall is commonly designated in the U.S. literature by the term "slurry trench". The drawback of such a method is the width of the trench, which is usually minimally 60 cm, while the depth of the trench is restricted by the length of the arm connected to the stationary portion of the excavating machine.

For installing narrower and usually also deeper trenches or walls in the soil, it is known for an H-shaped beam section with a soil displacement portion at its lower end to be driven into the ground by means of pile driving or vibro-driving. At the lower end of the beam section, below the soil displacement portion, the mouth of a feed tube is disposed, by means of which a supporting fluid is injected into the soil underneath the soil displacement portion. The supporting fluid may consist of a mixture of bentonite and cement to which may be added a filler, such as fly ash or brick dust. During the driving or vibro-driving of the beam into the soil, the supporting fluid present underneath the displacement portion is pressed upwardly along the walls of the displacement portion, while the supporting fluid is urged partly into the soil surrounding the displacement portion and partly arrives in the trench present above the displacement portion. During the driving of the beam into the soil, only a small portion of the trench made is filled with supporting fluid because an insufficient quantity of supporting fluid can be supplied underneath the displacement portion of the beam to fill the trench above the displacement portion entirely with supporting fluid. Pulling the beam out of the soil can only be effected at a very low speed, which is determined by the quantity of supporting fluid that can be conducted through a feed tube to below the displacement portion of the beam section. The trench made by driving the beam into the soil is first filled entirely with supporting fluid as the beam is being pulled out of the soil. When this method is used in coherent soil layers, such as clay layers, and the beam section is driven into the soil by vibro-driving, the displacement portion of the beam may get stuck, because the vibratory energy is adsorbed by the clay layers. The desired depth can then not be reached. In that case the beam section can no longer be loosened from the soil by vibration due to the contraction occurring above the displacement portion. Also vibrations exerted on the beam section during its extraction have no effect in such a case, since the vibratory energy is absorbed by the clay layers and hence does not result in loosening of the soil displacement portion of the beam from the walls of the trench.

It is an object of the present invention to provide an apparatus and a method of the above described type which eliminate the drawbacks of the known apparatuses and methods. The apparatus according to the present invention is characterized to that end in that the soil displacement portion of the beam consists of a box section substantially rectangular in cross-section with apertured side walls, said box section being provided at its underside with a shut-off plate whose edges project beyond the side walls of the box section. This shut-off plate closes the interior of the box section as the beam section is being driven into the soil and clears this interior during its extraction from the soil, with at least one feed tube for supporting fluid terminating in the interior of the box section.

By these means it is achieved that the cross section of the soil displacement portion during the driving into the ground of the beam section is larger than that during the extraction of the beam from the soil, so that a certain contraction of the trench is permissible. This contraction, in comparison with the above-described method, is opposed because during the thrusting of the beam section into the ground, the trench formed thereby is always filled entirely with a supporting fluid, or with a wall grout having a higher specific density than has the fluid used in the vibration method, thereby opposing contraction of the walls. Between the side walls of the soil displacement section and the walls of the trench, supporting fluid, having a lubricating function, may easily penetrate through the holes provided in the side walls of the soil displacement portion. Since, during extraction of the beam section from the soil, only such a quantity of supporting fluid need be supplied as corresponds with the volume of the beam section, said beam can be pulled out of the soil at relatively high speed.

A method of making a slurry trench or wall in the soil, using the above described apparatus comprises the following steps:

- driving a beam section into the ground, while simultaneously and entirely filling up the trench formed in the ground due to soil displacement with a supporting fluid
- fitting on the top of the beam section a clamping strap to which pulling cables are attached, with interposition of spring elements
- extracting the said beam out of the soil by means of the pulling cables, while simultaneously delivering blows at a suitable frequency to the beam so as to set this in a vertical, vibrating motion and
- supplying sufficient supporting fluid during extraction so as to fill up the volume occupied by the beam section.

Embodiments of the apparatus according to the present invention, as well as a method of using such an apparatus will now be described, by way of example, with reference to the accompanying drawings, in which.

Figure 1:
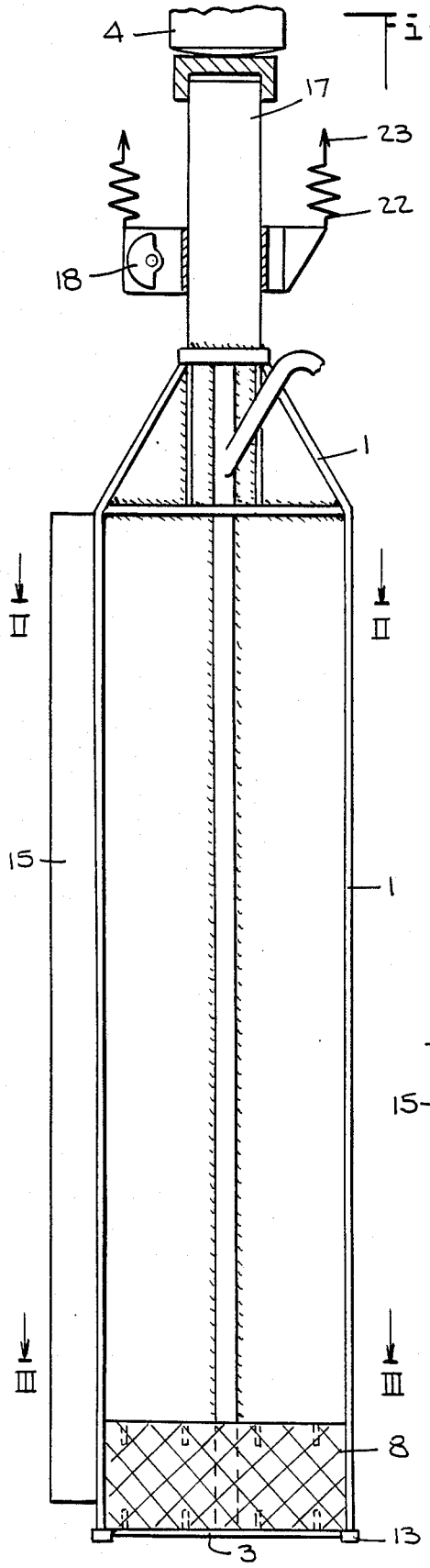
FIG. 1 shows a side view of a section beam, as well as parts of a ramming apparatus for driving said beam into the ground.
Figure 4:
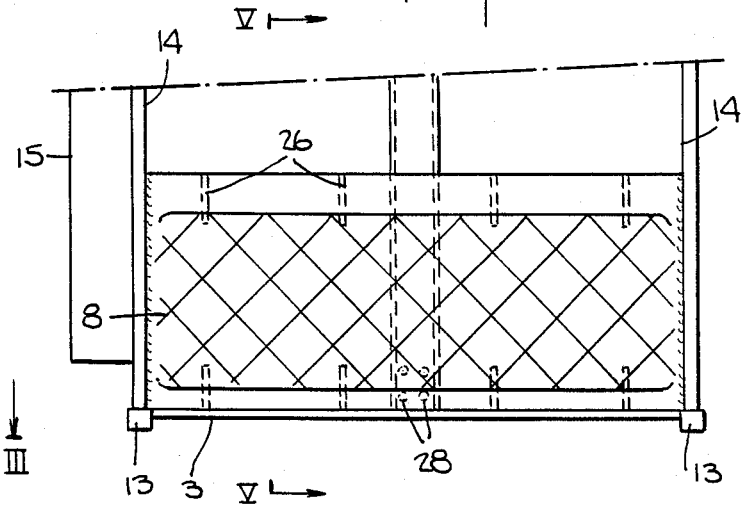
FIG. 4 is an enlarged view of the lower part of the beam section shown in FIG. 1.
Figure 6A:
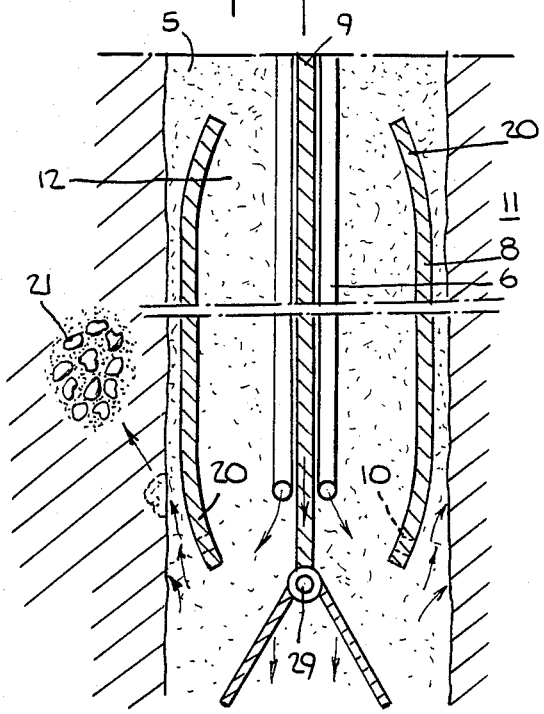
Figure 6B:
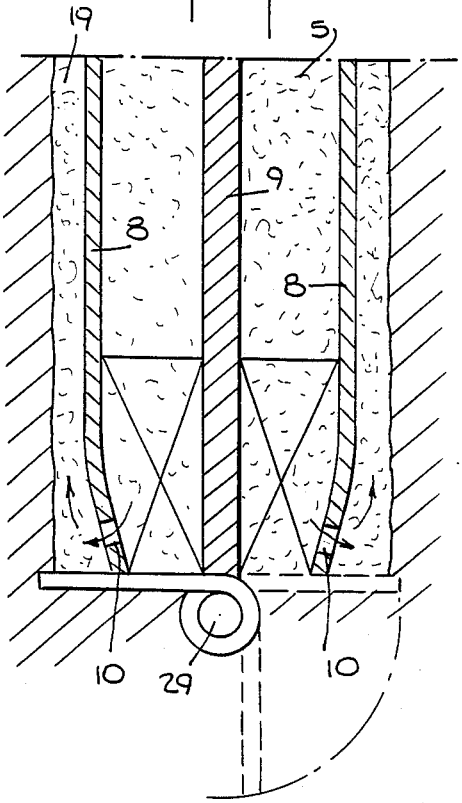
Figure 7:
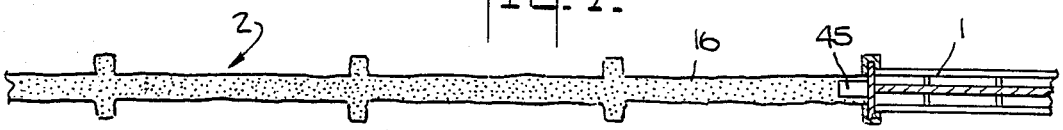

FIGS. 5a–d show several embodiments of the soil displacement portion of the beam section shown in FIG. 1, in cross section on the line V—V in FIG. 4;

FIGS. 6a–b show the soil displacement portion of the section beam shown in FIG. 1 received in a trench filled with the supporting fluid on a smaller scale (FIG. 6a); and on a larger scale (FIG. 6b); and FIG. 7 shows the construction of a slurry trench or wall from separate panels.

Figure 2:
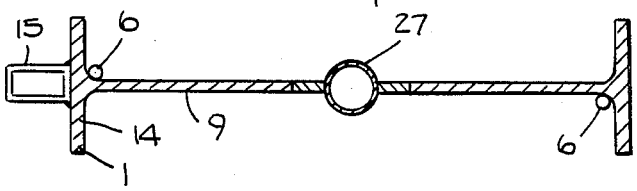
FIG. 2 is a cross section on the line II—II in FIG. 1.
Figure 3:
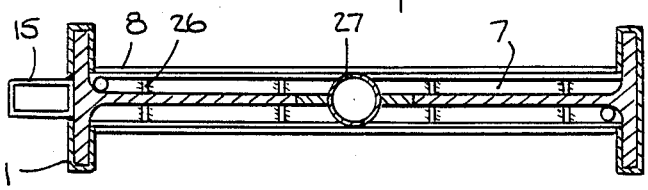
FIG. 3 is a cross section on the line III—III in FIG. 1.

FIGS. 1–3 show a sectional beam 1 of H-shaped cross section which is preferably used, since, among standard beam sections, those of H-shape are cheapest. Such a beam section is e.g. 30 m long, while the height between the flanges is e.g. 1 m. When beam sections of larger height than 1 m are to be used, the web 9 of such a beam can be cut in the centre, after which a stiffening tube 27 (FIG. 2) having laterally projecting plates is welded between the two parts of the beam onto the web 9 of the original H-shaped section, thereby forming a H-shaped section of e.g. 1.5 m high.

Above the beam section 1 there is positioned a piling punch 17 which can be hammered with a piling hammer 4 for driving the beam 1 into the ground. Clamped around the punch is a vibrator 18, the function of which will be further explained hereinafter. Mounted on the vibrator clamp are springs 22 the ends of which are connected to a pulling cable 23 for extracting beam 1 out of the soil. At the left of beam 1, a box section 15 is welded on a flange 14, the function of which will also be further explained hereinafter. At the bottom of beam 1, there are provided two side plates 8 between the two flanges 14. Said side plates 8 have a height of e.g. 50 cm and are connected to the web of the beam 1 by means of partitions 26. In this manner, two chambers 7 are formed on either side of web 9 of beam 1, which chambers 7 are closed at the bottom by means of a shut-off plate 3. To the bottom of flanges 14 of beam 1 there are welded blocks 13, which slightly project beyond the circumference of flanges 14 so as to reduce the friction on flanges 14 as section 1 is being driven into the ground. At chambers 7 terminates a feed tube 6 for supplying a slurry mix to chambers 7. When a stiffening tube 27 is present, this can also serve for supplying slurry mix to chambers 7. At the bottom of tube 27, there are then provided outlet holes 28 (see FIG. 4).

FIGS. 6a–b show the soil displacement portion of the beam section 1 in a trench 12 filled with slurry mix 5 and made by displacement. Said soil displacement portion comprises the two side plates 8 and the shut-off plate 3 adapted to shut off the bottom of said portion, as shown in FIG. 6b (left-hand side). Shut-off plate 3 consists in this case of two flaps hinged about a shaft 29, which in the closed position abut on the lower edges of side plates 8. Shaft 29 is connected to the web 9 of the beam section. The edges of flaps 3 opposite shaft 29 project beyond the main face of side plates 8, so that as beam 1 is driven into the ground, with the flaps 3 being in horizontal position, there is produced a trench 12 that is wider than the distance between the two side plates 8. Between the walls of the trench 2 disposed in bottom 11 and side plates 8 there is provided a space 19 which is filled with slurry mix 5 from the interior of the soil displacement portion through openings 10 provided in side plates 8. The slurry mix 5 is supplied to the interior soil displacement portion through the feed tubes 6 shown in FIG. 6.

The lower and upper edges 20 of plates 8 are flanged in the direction of web 9 of beam 1, so that both during the introduction and extraction of the beam into, and out of the soil respectively, there is produced a wedge effect adjacent the flanged edges 20, which presses a given quantity of slurry mix 5 into space 19 between side plates 8 and the walls of trench 12. A given quantity of this slurry mix 5 pressed into space 19 is pressed into the pores 21 of bottom 11, so that this is sealed both during the upward and downward movement of the beam 1.

During the extraction of beam 1 out of the soil, flaps 3 are opened, as shown in FIG. 6a, so that slurry mix 5 can flow from the interior of the soil displacement portion into the space underneath flaps 3 produced by the extraction of beam 1 out of the soil.

Figure 5A:
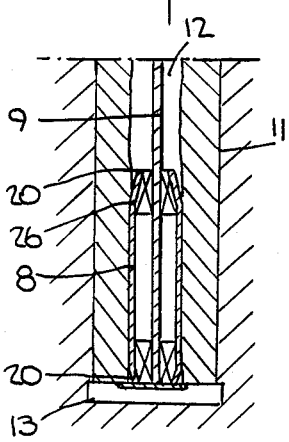
Figure 5B:
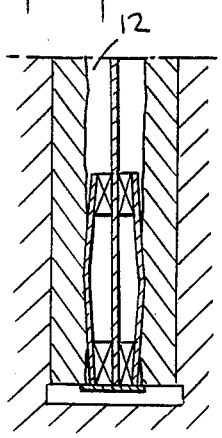
Figure 5C:
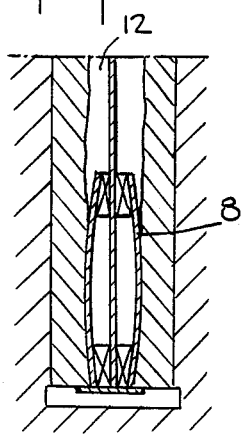
Figure 5D:
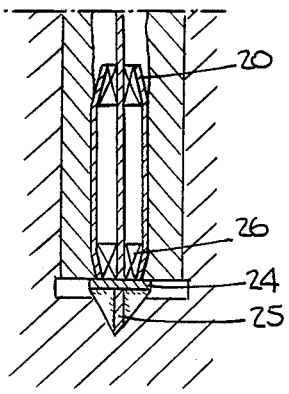

FIGS. 5a–c show a number of variants of the shape of the soil displacement portion. FIG. 5a corresponds with FIG. 6a, with the upper and lower edges 20 of side plates 8 being flanged in the direction of web 9 of sectional beam 1. Partitions 26 for connecting the side plates 8 to the web 9 are provided adjacent the beveled edges 20. In FIG. 5b not only the upper and lower edges of side plates 8 are flanged in the direction of web 9 but side plate 8 is roof-shaped. In FIG. 5c the side plates 8 are spherical, while the edges of the side plates are at a shorter interspace from the web 9 of beam 1 than the central portion of side plates 8. Both the embodiment shown in FIG. 5b and FIG. 5c show the wedge effect described in FIG. 6a during the upward and downward movement of the beam in the trench 12 filled with slurry mix 5.

When the soil in which the slurry trench or wall is to be made contains many obstacles, the flaps 3 may be damaged, resulting in malfunction. In that case flaps 3 can be replaced by a permanent pile shoe 24 shown in FIG. 5d. This pile shoe 24 may be provided at its bottom with a pyramidal construction 25 made of plates by means of which obstacles, if any, can be split or possibly urged sideways under the influence of the energy from the piling hammer. Pile shoe 24 is provided at its top with guide lugs engaging in the box section of the displacement portion, e.g. about partitions 26. Pile shoe 24 can be considered to be a loose cover remaining in the soil after lifting of the beam.

A method of making a slurry trench or wall in the soil, using the above-described apparatus, will be explained hereinafter with reference to FIGS. 1 and 6a, b.

The beam section 1 with horizontally arranged flaps 3 is placed on the soil wherein a trench has to be made. The beam is driven into the soil by means of a piling hammer 4, while the trench 12 formed by soil displacement is filled entirely with slurry mix 5 through feed tubes 6. This slurry mix enters through holes 10 provided in plates 8, space 19 between bottom 11 and plates 8 and due to the wedge effect produced by the flanged edges 20 of plates 8, this slurry mix is forced into space 19 and likewise into the pores 21 of the trench walls. Since the entire trench is filled with slurry mix already during the driving of the beam 1 into the ground, only a very limited contraction of said trench walls occurs.

After beam section 1 has reached the desired depth, a clamping strap with vibrator 18 is installed on piling punch 17 disposed on the top of beam 1, said clamping strap being engaged by pulling cables 23 through springs 22. During the pulling at cables 23, beam 1 is set vibrating either by means of vibrator 18 or by means of blows delivered to piling punch 17 at a suitable frequency with the piling hammer, which vibrating movement is superposed on the vertical movement produced by the pulling cables. With the beam section moving in upward direction, the flaps 3 occupy the position shown in FIG. 6a, so that slurry mix 5 can flow to the space being cleared below flaps 3. During the downward movement periodically given to the beam during its extraction, the flaps move in the direction of their horizontal position, whereby the supporting fluid present underneath flaps 3 is put under pressure. This has a favorable effect on the tightness of the side wall surfaces of trench 12, and increases the k-value (permeability coefficient) of the wall in a favorable sense. The flanged edges 20 and the resulting wedge effect result in that the soil displacement portion of the beam 1 can be easily pulled out of trench 12 even when a certain contraction of said walls has taken place during excavation of the trench. The extraction of beam 1 out of the soil can be effected rapidly, since during this extraction, only a limited amount of supporting fluid need be supplied to the trench.

FIG. 7 diagrammatically shows how a slurry trench or wall consisting of panels is made in the soil. At 16 is indicated a panel just completed whose shape corresponds with that of the beam section 1, as shown in the figures. At the right of the just completed panel 16, the next panel is made by driving beam section 1 into the ground. Box 15 then serves as a guiding sword and conforms to the shape of the just completed panel 16, so that a continuous wall is formed. Box 15 pierces through the fresh, not yet hardened grout with which panel 16 is filled. During the driving of beam 1 into the ground, an inclinometer can be lowered into the hollow box 15 for measuring and possibly recording deviations from straightness. By means of this recording, it can be established whether the contiguous panels still link up with each other completely even at a large depth.

I claim:

1. An apparatus for making a slurry trench or wall in the soil, substantially comprising a beam section provided at least at its bottom with a soil displacement portion, said beam being adapted to be driven into the soil by vibro-driving or pile driving, with simultaneous injection of a supporting fluid adjacent the soil displacement portion, and being subsequently extractable from the soil for forming a trench filled with supporting fluid, forming a slurry trench or wall after the supporting fluid has hardened, characterized in that said soil displacement portion (3,8) of the beam section (1) includes a box section substantially rectangular in cross-section and having side walls (8) provided with holes (10), said box section being provided at its bottom with a shut-off plate (3) whose edges project beyond the side walls (8) of the box section, said shut-off plate (3) shutting off the interior of the box section during the driving of beam (1) into the ground and clearing this interior during its extraction from the soil, at least one feed tube (6) for supporting fluid (5) terminating in the interior of the box section.

2. An apparatus as claimed in claim 1, characterized in that the shut-off plate (3) consists of a permanent pile shoe (24) provided with guide lugs engaging between the walls(8) of the box section, said pile shoe (24) remaining in the soil when the beam (1) is extracted from the soil.

3. An apparatus as claimed in claim 1, characterized in that the beam section includes a web and the shut-off plate comprises two flaps hinged about a shaft (29) which is affixed to the web.

4. An apparatus as claimed in claim 1, characterized in that the beam section (1) has an H-shaped cross-section and the side walls (8) of the soil displacement portion (3,8) are formed by two side plates arranged on either side of, parallel to and spaced from, the web (9) and within the flanges (14) of the H-shaped beam (1), while a feed tube (6) for supporting fluid (5) terminates in each of the chambers (7) formed by a side plate (8) and the web (9) of beam (1).

5. An apparatus as claimed in claim 4, characterized in that the upper and lower edges (20) of the side plates (8) are flanged in the direction of the web (4) of the H-shaped beam (1), while the holes (10) present in side plates (8) are provided in the flanged edges (20).

6. An apparatus as claimed in claim 4, characterized in that the side plates (8) are spherical, with the edges of the side plates being situated at a shorter interspace from the web (9) of the H-shaped beam (1) than the central portion of said side plates (8).

7. An apparatus as claimed in claim 4, characterized in that a box section (15) is welded to one of the flanges (14) of the H-shaped beam (1), at the side remote from web (9), said box section extending the entire length of the beam (1), with the width of said box section (15) being smaller than the interspace of the two side plates (8).

8. A method of making a slurry trench or wall in the bottom, using an apparatus according to any one claims 1-7, said method comprising driving a beam section into the ground while simultaneously and entirely filling up the trench formed in the ground due to soil displacement with a supporting fluid fitting on the top of the beam section a clamping strap to which pulling cables are attached, with interposition of spring elements extracting the beam section out of the soil by means of the pulling cables, while simultaneously delivering blows at a suitable frequency to the said beam so as to set this in a vertical, vibrating motion and supplying sufficient supporting fluid during extraction so as to fill up the volume occupied by the beam section.

* * * * *